US005877130A

United States Patent [19]

Kohara et al.

[11] Patent Number: 5,877,130

[45] Date of Patent: Mar. 2, 1999

[54] MACHINING OIL COMPOSITION

[75] Inventors: Masao Kohara; Hiroyasu Tamura; Hiroshi Tamaru, all of Kanagawa, Japan

[73] Assignee: Yushiro Chemical Industry Co., Ltd., Japan

[21] Appl. No.: 643,560

[22] Filed: May 6, 1996

Related U.S. Application Data

[63] Continuation of Ser. No. 235,952, May 2, 1994, abandoned.

[30] Foreign Application Priority Data

| | | | |
|---|---|---|---|
| Apr. 30, 1993 | [JP] | Japan | 5-128526 |
| May 24, 1993 | [JP] | Japan | 5-145489 |
| Feb. 24, 1994 | [JP] | Japan | 6-052893 |
| Feb. 24, 1994 | [JP] | Japan | 6-052894 |

[51] Int. Cl.[6] ..... C10M 125/22; C10M 125/10

[52] U.S. Cl. ..... 508/174; 508/179; 508/180

[58] Field of Search ..... 508/174, 179, 508/180

[56] References Cited

U.S. PATENT DOCUMENTS

| | | | |
|---|---|---|---|
| Re. 31,611 | 6/1984 | Wainwright et al. | 252/25 |
| 2,614,986 | 10/1952 | Beerbower et al. | 252/25 |
| 2,964,474 | 12/1960 | Alford | 508/174 |
| 3,065,173 | 11/1962 | Blake et al. | 252/25 |
| 3,065,174 | 11/1962 | Blake et al. | 252/25 |
| 3,065,175 | 11/1962 | Blake et al. | 252/25 |
| 3,278,432 | 10/1966 | Davis . | |
| 3,313,728 | 4/1967 | Glasson et al. | 252/25 |
| 3,730,895 | 5/1973 | Kjonaas | 508/179 |
| 3,801,503 | 4/1974 | Hartmann | 252/18 |
| 4,159,252 | 6/1979 | Wainwright et al. | 252/25 |
| 4,164,472 | 8/1979 | Cheng et al. | 252/25 |
| 4,416,788 | 11/1983 | Apikos . | |
| 4,505,830 | 3/1985 | Vinci . | |
| 4,830,767 | 5/1989 | Waynick | 252/25 |
| 5,126,062 | 6/1992 | Barnes | 508/179 |
| 5,164,102 | 11/1992 | Everett et al. | 252/18 |
| 5,284,591 | 2/1994 | Bayles, Jr. et al. | 252/18 |

OTHER PUBLICATIONS

Lubricant Additives, Smalheer and Smith, pp. 1–11, 1967.

*Primary Examiner*—Jerry D. Johnson

*Attorney, Agent, or Firm*—Finnegan, Henderson, Farabow, Garrett & Dunner, L.L.P.

[57] ABSTRACT

A machining oil composition comprises at least two ingredients, that is a lubricating base oil and a salt selected from sulfonates of alkali metals and the like. The composition may further comprise a metal composition selected from thiophosphates and the like, and/or sulfur-based extreme pressure agents. Since no chlorine-based extreme pressure agent is contained, little problem on the environmental pollution or the damage of incinerators is involved. The composition exhibits good machining or cutting performance.

16 Claims, No Drawings

MACHINING OIL COMPOSITION

This application is a continuation, of application Ser. No. 08/235,952, filed May 2, 1994, now abandoned.

BACKGROUND OF THE INVENTION

Industrial Field of Utilization

This invention relates to a machining oil composition and more particularly, to an oil composition which is suitably adapted for use in broaching and tapping. The invention is applicable to the preparation of lubricants and machining of metals.

Description of The Prior Art

Various types of compositions have been hitherto employed as an oil for machinings such as broaching, tapping and the like. In general, there are formulated, in base oils such as mineral oils, oils and fats or synthetic lubricants, various types of additives such as chlorine-based extreme pressure agents, sulfur-based extreme pressure agents, phosphorus-based extreme pressure agents, organometallic compound extreme pressure agents, oiliness improvers such as, for example, oils and fats, esters and the like, antioxidants, antirust agents, defoamers, antirust agents for non-ferrous metals and the like.

Of the various types of extreme pressure agents, the chlorine and sulfur-based agents have been predominantly used owing to their good machining performance and relative inexpensiveness. The chlorine-based extreme pressure agents include, for example, chlorinated paraffins, chlorinated fatty acids, chlorinated fatty acid esters and the like. The sulfur-based extreme pressure agents include sulfurated fatty oils, polysulfides and the like.

In recent years, however, where water-insoluble machining oils formulated with chlorine-based extreme pressure agents are used, there have been sometimes pointed out problems such as the ecological problem caused by generation of harmful substances at the time of incineration of the oils and the problem of damaging the incinerator. In addition, there is some fear on the possibility that a certain type of chlorinated paraffin is toxic and carcinogenic.

Accordingly, there is a strong demand for the development of a machining oil or a machining oil composition which is substantially free of any harmful ingredients such as chlorine-based extreme pressure agents and exhibits good machining performance (e.g. a prolonged tool life).

SUMMARY OF THE INVENTION

Objects of The Invention

An object of the invention is to provide a machining oil composition which overcomes the problems of the prior art and which has better machining performance than machining oils comprising base oils to which sulfur-based extreme pressure agents alone are added.

Another object of the invention to provide a machining oil composition which is free of any chlorine-based extreme pressure agent whereby there can be suppressed the problems such as the ecological problem and the problem of damaging incinerators as will be caused by generation of harmful substances at the time of incineration of machining oils containing chlorine-based extreme pressure agents.

A further object of the invention is to provide a machining oil composition which ensures good machining performance or prolonged tool life when applied to broaching or tapping operations.

Features of The Invention

According to the first present invention, there is provided a machining oil composition (hereinafter referred to simply as "oil composition") which comprises: (a) a lubricating base oil containing at least one member selected from mineral oils, fats and oils and synthetic lubricating oils; and (b) at least one salts selected from the group consisting of sulfonates of alkali metals, sulfonates of alkaline earth metals, carbonates of alkali metals and carbonates of alkaline earth metals, substantially no chlorine-based extreme pressure agents are contained.

According to the second present invention, there is also provided a oil composition which comprises: (a) a lubricating base oil containing at least one member selected from mineral oils, fats and oils and synthetic lubricating oils; (b) at least one salt selected from the group consisting of sulfonates of alkali metals, sulfonates of alkaline earth metals, carbonates of alkali metals and carbonates of alkaline earth metals; and (c) at least one metal compound selected from the group consisting of zinc thiophosphates, molybdenum thiophosphates, zinc thiocarbamates and molybdenum thiocarbamates and/or (d) a sulfur-based extreme pressure agent.

According to the third present invention, there is also provided a oil composition which comprises: (a) a lubricating base oil containing at least one member selected from mineral oils, fats and oils and synthetic lubricating oils; (b) at least one salt selected from the group consisting of sulfonates of alkali metals, sulfonates of alkaline earth metals, carbonates of alkali metals and carbonates of alkaline earth metals; and (d) a sulfur-based extreme pressure agent, substantially no chlorine-based extreme pressure agents are contained.

According to the fourth present invention, there is also provided a oil composition which comprises: (a) a lubricating base oil containing at least one member selected from mineral oils, fats and oils and synthetic lubricating oils; (b) at least one salt selected from the group consisting of sulfonates of alkali metals, sulfonates of alkaline earth metals, carbonates of alkali metals and carbonates of alkaline earth metals; (c) at least one metal compound selected from the group consisting of zinc thiophosphates, molybdenum thiophosphates, zinc thiocarbamates and molybdenum thiocarbamates; and (d) a sulfur-based extreme pressure agent, substantially no chlorine-based extreme pressure agents are contained.

Effects of The Invention

The machining oil composition of the invention exhibits good machining performance without use of any chlorine-based extreme pressure agent and produces little harmful substances during the course of wastage and incineration, thus not causing a serious problem on environmental pollution or the damage of incinerators. Further, the composition of the invention has better machining performance than machining oils comprising base oils to which only extreme pressure agents such as chlorine-based agents are added.

DETAILED DESCRIPTION OF THE INVENTION

The "mineral oil" used as the lubricating base oil of ingredient (a) includes, for example, kerosene, gas oil, spindle oil, machine oil, turbine oil, cylinder oil, liquid paraffin and the like. The "oils and fats" includes, for example, tallow, lard, rape oil, coconut oil, palm oil, bran oil or hydrogenated oils thereof. The "synthetic lubricating oils" includes, for example, fatty acids obtained from the above fats and oils, esters of fatty acids and alcohols, polyolefins such as polybutene, polyols such as polyethylene glycol, polyol esters and the like, polyethers, polyesters, or higher alcohols.

As the ingredient (b), there may be used at least one salt selected from alkali metal sulfonates, alkaline earth metal sulfonates, alkali metal carbonates and alkaline earth metal carbonates. The alkali metal in the ingredient (b) is at least one member selected from potassium and sodium and the alkaline earth metal is calcium. Preferable sulfonates include potassium sulfonate, sodium sulfonate and calcium sulfonate, and preferable carbonates include potassium carbonate, sodium carbonate and calcium carbonate.

The ingredient (c) used in the present invention is at least one metal compound selected from four types of zinc thiophosphate compounds, molybdenum thiophosphate compounds, zinc thiocarbamate compound and molybdenum thiocarbamate compounds.

Specific examples include zinc dithiophosphate, molybdenum dithiocarbamate and the like.

The contents of the ingredients (b) and (c) are, respectively, in the range of from 1 to 80 parts by weight per 100 parts by weight of the oil composition. Preferably, the contents are, respectively, from 2 to 60 parts by weight, per 100 parts by weight of the oil composition, within which better machining performance is attained. If the content is less than 1 part by weight, the tool life is not satisfactorily prolonged in the machining operation. On the contrary, when the content exceeds 80 parts by weight, a further effect is not expected with poor economy.

The ingredient (d) may be sulfurated fatty oils, sulfurated fatty acids, polysulfides and sulfur powder. The content of the ingredient (d) is in the range of from 0.05 to 80 parts by weight per 100 parts by weight of the composition. Preferably, the content is in the range of from 0.1 to 60 parts by weight, with which better machining performance is ensured. If the content is less than 0.05 parts by weight, a satisfactorily prolonged tool life is not expected. Over 80 parts by weight, a further effect is not attained.

In the practice of the invention, aside from these essential ingredients, various additives may be appropriately added to the composition. Such additives include, for example, anti-rust agents, antioxidants, defoamers, anti-corrosive agents for non-ferrous metals, and the like.

EXAMPLES

The invention is described in more detail by way of examples.

(1) Preparation of Oil Compositions

1) Examples 1 to 12 and Comparative Examples 1 to 5

As is particularly shown in Table 1, the examples made use of oil compositions which were comprised of ingredient (a) and ingredient (b). In the comparative examples, there were used oil compositions which were comprised of ingredient (a) to which a extreme pressure agent or agents alone were added. The results of a performance test are shown in Table 2.

TABLE 1

| | Examples | | | | | | | | | | | | Comparative Examples | | | | |
|---|---|---|---|---|---|---|---|---|---|---|---|---|---|---|---|---|---|
| Ingredients | 1 | 2 | 3 | 4 | 5 | 6 | 7 | 8 | 9 | 10 | 11 | 12 | 1 | 2 | 3 | 4 | 5 |
| Spindle oil | 65 | 65 | 65 | 60 | 65 | 60 | 65 | 70 | 70 | 50 | 50 | 20 | 70 | 65 | 65 | 10 | 73 |
| Machine oil | 25 | 15 | 25 | 10 | 15 | — | 15 | — | 10 | — | 48 | — | 15 | 25 | 15 | 10 | 15 |
| Rape oil | — | — | — | 10 | — | — | — | — | — | 10 | — | — | 10 | — | 10 | 10 | 10 |
| Potassium sulfonate | 10 | 10 | — | — | — | 40 | — | — | — | — | 2 | — | — | — | — | — | — |
| Sodium sulfonate A | — | — | 10 | — | — | — | 10 | — | — | — | — | — | — | — | — | — | — |
| Sodium sulfonate B | — | — | — | — | — | — | — | 30 | — | — | — | — | — | — | — | — | — |
| Calcium sulfonate A | — | — | — | 10 | — | — | — | — | — | — | — | — | — | — | — | — | — |
| Calcium sulfonate B | — | — | — | — | 20 | — | — | — | 10 | 40 | — | 40 | — | — | — | — | — |
| Potassium carbonate | — | 10 | — | — | — | — | — | — | — | — | — | — | — | — | — | — | — |
| Calcium carbonate | — | — | — | 10 | — | — | — | — | 10 | — | — | 40 | — | — | — | — | — |
| Sodium carbonate | — | — | — | — | — | — | 10 | — | — | — | — | — | — | — | — | — | — |
| Chlorinated paraffin | — | — | — | — | — | — | — | — | — | — | — | — | 5 | 5 | 5 | 5 | 2 |
| Chlorinated fatty acid ester | — | — | — | — | — | — | — | — | — | — | — | — | — | — | 5 | — | — |
| Sulfurated fatty oil | — | — | — | — | — | — | — | — | — | — | — | — | — | 5 | — | — | — |
| Polysulfide | — | — | — | — | — | — | — | — | — | — | — | — | — | — | — | 5 | — |

2) Examples 13 to 22 and Comparative Examples 6 to 10

As shown in Table 3, there were used in these examples, oil compositions which contained ingredient (a), ingredient (b) and ingredient (c). In the comparative examples, there were used oil compositions which contained ingredient (a) and a extreme pressure agent, or ingredient (d) was further added to the composition. The results of the performance test are shown in Table 4.

3) Examples 23 to 33 and Comparative Examples 11 to 17

As shown in Table 5, these examples made use of oil compositions which contained ingredient (a), ingredient (b) and ingredient (d). In the comparative examples, there were used oil compositions which contained ingredient (a) and extreme pressure agents or ingredient (b) (Comparative Example 15 does not fall in the scope of the claim 2 but fall in the scope of the claim 1). The results of the performance test are shown in Table 6.

TABLE 2

| | Examples | | | | | | | | | | | | | Comparative Examples | | | | |
|---|---|---|---|---|---|---|---|---|---|---|---|---|---|---|---|---|---|---|
| | 1 | 2 | 3 | 4 | 5 | 6 | 7 | 8 | 8 | 9 | 10 | 11 | 12 | 1 | 2 | 3 | 4 | 5 |
| Condition A | — | — | — | — | — | 50 | 40 | 40 | 40 | 40 | 50 | 20 | 60 | — | — | 30 | 30 | 20 |
| Condition B | 130 | 150 | 140 | 150 | 160 | — | — | — | — | — | — | — | — | 100 | 110 | — | — | — |

TABLE 3

| | Examples | | | | | | | | | | Comparative Examples | | | | |
|---|---|---|---|---|---|---|---|---|---|---|---|---|---|---|---|
| Ingredients | 13 | 14 | 15 | 16 | 17 | 18 | 19 | 20 | 21 | 22 | 6 | 7 | 8 | 9 | 10 |
| Spindle oil | 70 | 60 | 50 | 40 | 60 | 30 | 60 | 23 | 28 | 95 | 70 | 70 | 65 | 70 | 65 |
| Machine oil | 10 | 10 | — | — | — | — | — | — | — | — | 15 | 15 | 15 | 5 | 10 |
| Rape oil | — | — | 10 | — | — | — | — | — | — | — | 10 | — | 10 | 10 | — |
| Potassium sulfonate | 10 | — | — | 30 | — | — | — | 65 | 1 | 1.5 | — | — | — | — | — |
| Sodium sulfonate | — | 10 | — | — | — | — | — | — | — | — | — | — | — | — | — |
| Calcium sulfonate A | — | — | 10 | — | — | — | — | — | — | — | — | — | — | — | — |
| Calcium sulfonate B | — | — | — | — | 20 | 40 | — | — | — | — | — | — | — | — | — |
| Potassium carbonate | — | — | — | 10 | — | — | — | 10 | 1 | 1.5 | — | — | — | — | — |
| Sodium carbonate | — | 10 | — | — | — | — | — | — | — | — | — | — | — | — | — |
| Calcium carbonate | — | — | 10 | — | — | — | 20 | — | — | — | — | — | — | — | — |
| Zinc dithiophosphate | — | 10 | 20 | — | 20 | 30 | 20 | 2 | 50 | 1 | — | — | — | — | 20 |
| Molybdenum thiocarbarnate | 10 | — | — | 20 | — | — | — | — | 20 | 1 | — | — | — | — | — |
| Chlorinated paraffin | — | — | — | — | — | — | — | — | — | — | 5 | 5 | 5 | 5 | 5 |
| Chlorinated fatty acid ester | — | — | — | — | — | — | — | — | — | — | — | — | 5 | — | — |
| Sulfurated fatty oil | — | — | — | — | — | — | — | — | — | — | — | 10 | — | — | — |
| Polysulfide | — | — | — | — | — | — | — | — | — | — | — | — | — | 10 | — |

TABLE 4

| | Examples | | | | | | | | | | Comparative Examples | | | | |
|---|---|---|---|---|---|---|---|---|---|---|---|---|---|---|---|
| | 13 | 14 | 15 | 16 | 17 | 18 | 19 | 20 | 21 | 22 | 6 | 7 | 8 | 9 | 10 |
| Condition A | — | — | — | 50 | 50 | 60 | 50 | — | 80 | — | — | — | 30 | 35 | 35 |
| Condition B | 140 | 160 | 170 | — | — | — | — | 110 | — | 135 | 100 | 120 | — | — | — |

TABLE 5

| | Examples | | | | | | | | | | | Comparative Examples | | | | | | |
|---|---|---|---|---|---|---|---|---|---|---|---|---|---|---|---|---|---|---|
| Ingredients | 23 | 24 | 25 | 26 | 27 | 28 | 29 | 30 | 31 | 32 | 33 | 11 | 12 | 13 | 14 | 15 | 16 | 17 |
| Spindle oil | 65 | 60 | 50 | 70 | 70 | 45 | 63.4 | 60.5 | 45 | 35 | 50 | 60 | 60 | 60 | 60 | 55 | 65 | 65 |
| Machine oil | 10 | 10 | — | — | — | 40 | — | — | — | — | — | 15 | 25 | — | — | — | 15 | 10 |
| Rape oil | — | — | 10 | — | — | 11.8 | 5 | 7.9 | 15 | — | — | 10 | — | 20 | 20 | 15 | 10 | 10 |
| Potassium sulfonate | 10 | — | — | 20 | — | — | — | — | 30 | — | — | — | — | — | — | 30 | — | — |
| Sodium sulfonate | — | 10 | — | — | — | — | — | — | — | — | — | — | — | — | — | — | — | — |
| Caldium sulfonate A | — | — | 10 | — | — | 1.5 | 1.5 | 30 | — | — | — | — | — | — | — | — | — | — |
| Caldium sulfonate B | — | — | — | — | — | — | — | — | — | 5 | 40 | — | — | — | — | — | — | — |
| Potassium carbonate | — | — | — | — | 20 | — | — | — | — | — | — | — | — | — | — | — | — | — |
| Sodium carbonate | — | 10 | — | — | — | — | — | — | — | — | — | — | — | — | — | — | — | — |
| Calcium carbonate | — | — | 10 | — | — | 1.5 | 30 | 1.5 | — | — | — | — | — | — | — | — | — | — |
| Sulfurated fatty oil | 10 | — | 10 | — | — | — | — | — | — | 30 | — | — | 10 | 10 | — | — | — | — |
| Polysulfide | 5 | 10 | 10 | 10 | 10 | — | — | — | 10 | 30 | 10 | 10 | — | 10 | — | — | — | 10 |
| Sulfur powder | — | — | — | — | — | 0.2 | 0.1 | 0.1 | — | — | — | — | — | — | — | — | — | — |
| Chlorinated paraffin | — | — | — | — | — | — | — | — | — | — | — | 5 | 5 | — | 10 | — | 5 | 5 |
| Chlorinated fatty acid ester | — | — | — | — | — | — | — | — | — | — | — | — | — | — | 10 | — | 5 | — |

TABLE 6

| | Examples | | | | | | | | | | | Comparative Examples | | | | | | |
|---|---|---|---|---|---|---|---|---|---|---|---|---|---|---|---|---|---|---|
| | 23 | 24 | 25 | 26 | 27 | 28 | 29 | 30 | 31 | 32 | 33 | 11 | 12 | 13 | 14 | 15 | 16 | 17 |
| Condition A | — | — | — | — | — | — | 45 | 50 | 50 | 60 | 60 | — | — | — | — | 40 | 30 | 30 |
| Condition B | 140 | 160 | 110 | 160 | 160 | 125 | — | — | — | — | — | 100 | 120 | 100 | 100 | — | — | — |

4) Examples 34 to 47 and Comparative Examples 18 to 22

As shown in Table 7, there were used, in these examples, oil compositions which contained ingredient (a), ingredient (b), ingredient (c) and ingredient (d) in combination. In the comparative examples, there were used oil compositions containing ingredient (a) and a chlorine-based extreme pressure agent, or ingredient (d), ingredient (d) and ingredient (c) were further added to the composition. The results of the performance test are shown in Table 8.

TABLE 7

| | Examples | | | | | | | | | | | | | | Comparative Examples | | | | |
|---|---|---|---|---|---|---|---|---|---|---|---|---|---|---|---|---|---|---|---|
| Ingredients | 34 | 35 | 36 | 37 | 38 | 39 | 40 | 41 | 42 | 43 | 44 | 45 | 46 | 47 | 18 | 19 | 20 | 21 | 22 |
| Spindle oil | 60 | 50 | 40 | 40 | 40 | 40 | 60 | 40 | 40 | 60 | 70 | 10 | 10 | 10 | 70 | 60 | 65 | 65 | 45 |
| Machine oil | 10 | 5 | — | — | — | — | 10 | 8 | 8 | 9.9 | 25.9 | — | — | — | 15 | 25 | 15 | 10 | — |
| Rape oil | — | — | 10 | — | 10 | — | — | — | — | — | — | — | — | — | 10 | — | 10 | 10 | — |
| Potassium sulfonate | 10 | — | — | 10 | — | — | — | — | 1 | 10 | 1 | 10 | 60 | 10 | — | — | — | — | — |
| Sodium sulfonate | — | 10 | — | — | — | — | — | — | — | — | — | — | — | — | — | — | — | — | — |
| Calcium sulfonate A | — | — | 1.0 | — | — | — | — | — | — | — | — | — | — | — | — | — | — | — | — |
| Calcium sulfonate B | — | — | — | — | 10 | 20 | — | 10 | — | — | — | — | — | — | — | — | — | — | — |
| Potassium carbonate | — | — | — | 10 | — | — | — | — | 1 | — | 1 | — | 10 | — | — | — | — | — | — |
| Sodium carbonate | — | 10 | — | — | — | — | — | — | — | — | — | — | — | — | — | — | — | — | — |
| Calcium carbonate | — | — | 10 | — | — | — | 10 | 20 | — | 10 | — | — | — | — | — | — | — | — | — |
| Zinc dithiophosphate | — | 10 | 20 | — | 20 | 30 | — | 2 | 25 | — | 2 | 45 | 10 | 10 | — | — | — | — | 30 |
| Molybdenum dithiocarbamate | 10 | — | — | 20 | — | — | 10 | — | — | 10 | — | 25 | — | — | — | — | — | — | 10 |
| Sulfurated fatty oil | — | 10 | — | 10 | — | — | — | 20 | 25 | — | — | 10 | 10 | 25 | — | 10 | — | — | 10 |
| Polysulfide | 10 | 5 | 10 | 10 | 20 | 10 | 10 | — | — | — | — | — | — | 45 | — | — | — | 10 | — |
| Sulfur powder | — | — | — | — | — | — | — | — | — | 0.1 | 0.1 | — | — | — | — | — | — | — | — |
| Chlorinated paraffin | — | — | — | — | — | — | — | — | — | — | — | — | — | — | 5 | 5 | 5 | 5 | — |
| Chlorinated fatty acid ester | — | — | — | — | — | — | — | — | — | — | — | — | — | — | — | — | 5 | — | 5 |

TABLE 8

| | Examples | | | | | | | | | | | | | | Comparative Examples | | | | |
|---|---|---|---|---|---|---|---|---|---|---|---|---|---|---|---|---|---|---|---|
| | 34 | 35 | 36 | 37 | 38 | 39 | 40 | 41 | 42 | 43 | 44 | 45 | 46 | 47 | 18 | 19 | 20 | 21 | 22 |
| Condition A | — | — | — | 55 | 60 | 60 | — | — | 50 | 50 | — | — | 60 | 60 | — | — | 30 | 35 | — |
| Condition B | 140 | 160 | 180 | — | — | — | 150 | 170 | — | — | 140 | 180 | — | — | 100 | 120 | — | — | 130 |

In Tables 1, 3, 5 and 7 showing the formulations of the respective oil compositions, the amounts of the respective ingredients in the examples and comparative examples are expressed in terms of parts by weight per 100 parts by weight of the total of each oil composition. The ingredients used are particularly indicated below.

1) Potassium sulfonate: commercially available from Nippon Lubrizole Ind. Co., Ltd. under the commercial name of [LZOS 87931A ].
2) Sodium sulfonate: commercially available from Nippon Lubrizole Ind. Co., Ltd. under the commercial name of [LZ5318].
3) Calcium sulfonate A: commercially available from Witco Chemical Corporation under the commercial name of [SACI 100].
4) Calcium sulfonate B: commercially available from Nippon Lubrizole Ind. Co., Ltd. under the commercial name of [LZ5283].
5) Potassium carbonate: available from Wako Pure Chemical Industries, Ltd. (average particle size not larger than 0.1 μm)
6) Sodium carbonate: available from Wako Pure Chemical Industries, Ltd. (average particle size not larger than 0.1 μm)
7) Calcium carbonate: available from Wako Pure Chemical Industries, Ltd. (average particle size not larger than 0.1 μm)
8) Chlorinated paraffin: available from Ajinomoto Co., Inc. under the commercial name of [EMPARA K45].
9) Chlorinated fatty acid ester: available from Asahi Denka Kogyo K.K. under the commercial name of [ADEKALUBE CB450 ].
10) Zinc dithiophosphate: available from Nippon Cooper Co., Ltd. under the commercial name of [HITICE 682].
11) Molybdenum dithiocarbamate: available from Asahi Denka Kogyo K.K. under the commercial name of [SAKURALUBE 100].
12) Sulfurated fatty oil: available from Dainippon Ink and Chemicals, Incorporated, under the commercial name of [DAILUBE GS210 ].
13) Polysulfide: available from Nippon Thiochemicals Co., Ltd. under the commercial name of [TOPS].

(2) Performance test

In order to clarify the performance of the oil compositions of the examples and comparative examples, the following test was conducted.

The procedure and conditions of the performance test are set out below.

1) Machining: broaching
2) Tool: one-blade surface broaching tool (SKH55)
3) Testing machine: high speed broach tester (available from Nachi-Fujikosi Corp.)
4) Depth of cut: 0.08 mm/test cycle
5) length of cut: 50 mm/test cycle
6) feed of oil composition: 4 liters/minute Evaluation of performance: the tool life was assessed in terms of a cut length (m) before the width of wear at the maximum relief face arrived at 0.3 mm, Conditions A: a material to be cut or machined; SUS304 (hardness Hb of 320) and cutting speed; 1.0 mm/minute.

Conditions B: a material to be cut or machined; S45C (hardness Hb of 210) and cutting speed; 6.0 mm/minute.

According to the results of Table 2, with Example 11 where the content of potassium sulfonate (i.e. an alkali metal sulfonate) is relatively small, the tool life is inferior to those of other examples and is equal to that of Comparative Example 5 using the smallest content of chlorinated paraffin among the comparative examples 1 to 5. With the other examples in Table 2, the tool life can be prolonged by about 30 to 100% over those of the comparative examples.

Thus, the oil compositions of the examples ensure good cutting performance or can significantly improve the performance without use of any extreme pressure agents.

The results of Table 4 reveal that with the examples using combinations of ingredient (a), ingredient (b) and ingredient (c), good cutting performance is attained in all the cases irrespective of the types of compounds for these ingredients. In addition, good cutting performance is realized in Examples 20 and 21 where the content of ingredient (c) or the contents of ingredients (b) are small within a range of the invention and also in Example 22 where the contents of ingredients (b) and (c) are all small.

On the other hand, with the Comparative Examples which make use, aside from the base oils, of a extreme pressure agent, the cutting performance is significantly inferior to those of the examples of the present invention. In Comparative Example 10, in the composition of ingredients (a) and a extreme pressure agent, ingredient (c) is further added in combination but the performance of the oil is inferior. From these results, it will be seen that the use of ingredient (b) is essential.

The above results reveal that the oil compositions which comprise, aside from the lubricating base oil, a specific type of sulfonate and a specific type of zinc thiophosphate and the like as essential ingredients can remarkably improve the machining or cutting performance.

According to the results of Table 6, with the examples where sulfonate alone, carbonate alone or combinations of sulfonate and carbonate for ingredient (b) are added to ingredients (a) and (d), good cutting performance is ensured in all the cases. With the cases where ingredients (b) and (d) are small in content as in Example 28, where the content of sulfonate for ingredient (b) and ingredient (d) are small as in Example 29, and where the content of carbonate for ingredient (b) and ingredient (d) are small as in Example 30, where the content of ingredient (b) is relatively small and ingredient (d) is large as in Example 32, good cutting performance is attained using a very small or large amount of ingredient (d) in all the cases.

In contrast, with the comparative examples where ingredient (a) and a chlorine-based extreme pressure agent and a sulfur-based extreme pressure agent are used in combination but using no ingredient (b) as in Examples 11, 12 and 17, where the sulfur or chlorine-based extreme pressure agent is used in an amount as much as 20 parts by weight but ingredient (b) is not used as in Example 13 and 14, and where ingredient (b) is used but no extreme pressure agent is used as in Example 15, cutting performance is considerably poor in all the cases. From these results, it will be seen that when a specific type of sulfonate and the like and a sulfur-based extreme pressure agent are added to the lubricating base oil or oils as the essential ingredients, the cutting performances is significantly improved.

According to the results of Table 8, with the examples where ingredients (a), (b), (c) and (d) are contained, good cutting performance is obtained in all the cases irrespective of the types of compounds for these ingredients. Moreover when the contents of the ingredients (c), (b) or (d) are respectively small as in Examples 41, 42 and 43, and as in Example 44 where the contents of ingredients (b), (c) and (d) are small or when the contents of the ingredients are very large as in Examples 45, 46 and 47 where some ingredients among ingredients (c), (b) and (d) are very small or large, good cutting performance is realized.

On the other hand, with Comparative Examples 18 and 20 where the chlorine-based extreme pressure agent or agents are added alone to ingredient (a), Comparative Examples 19 and 21 where chlorine and sulfur-based extreme pressure agents are used in combination with ingredient (a), and Comparative Example 22 where ingredient (c) and the chlorine-based extreme pressure agent are added to ingredient (a), the cutting performance is considerably inferior to those of the examples. In Comparative Example 22, ingredient (c), (d) and the chlorine-based extreme pressure agent are used in combination with ingredient (a), but the performance is not good. From this, it will be seen that aside from the ingredients (a), (c) and (d) used in the above comparitive example, addition of ingredient (b) can provide better results according to the present invention.

From these results, when a specific type of sulfonate or the zinc thiophosphate and the like and a sulfur-based extreme pressure agent are used, as the essential ingredients, in combination with lubricating base oils, the cutting performance can be further improved. Thus, these combinations are preferred in the practice of the invention.

What is claimed is:

1. A machining oil composition comprising:

(a) a lubricating base oil comprising at least one member selected from mineral oils, fats and oils, and synthetic lubricating oils; and (b) 10 to 80 parts by weight, per 100 parts by weight of the composition, of:

1 to 65 parts by weight, per 100 parts by weight of the composition, of at least one inorganic sulfonate salt selected from an alkali metal sulfonate salt and an alkaline earth metal sulfonate salt; and 1 to 40 parts by weight, per 100 parts by weight of the composition, of at least one inorganic carbonate salt selected from an alkali metal carbonate salt and an alkaline earth metal carbonate salt.

2. A machining oil composition according to claim 1, 100 parts by weight of which contains 20 to 90 parts by weight of ingredient (a), and 10 to 80 parts by weight of ingredient (b).

3. The machining oil composition according to claim 1, wherein the oil composition contains substantially no chlorine-based extreme pressure agents.

4. The machining oil composition according to claim 1, further comprising (c) 10–80 parts by weight, per 100 parts by weight of the composition, of at least one zinc thiophosphate, molybdenum thiophosphate, zinc thiocarbamate, or molybdenum thiocarbamate.

5. A machining oil composition according to claim 4, 100 parts by weight of which contains 23 to 80 parts by weight of ingredient (a), 10 to 75 parts by weight of ingredient (b), and 10 to 70 parts by weight of ingredient (c).

6. The machining oil composition according to claim 1, further comprising (d) 0.05–80 parts by weight, per 100 parts by weight of the composition, of a sulfur-based extreme pressure agent.

7. A machining oil composition according to claim 6, 100 parts by weight of which contains 35 to 80 parts by weight of ingredient (a), 10 to 40 parts by weight of ingredient (b), and 10 to 60 parts by weight of ingredient (d).

8. The machining oil composition according to claim 1, further comprising:

(c) 10–80 parts by weight, per 100 parts by weight of the composition, of at least one zinc thiophosphate, molybdenum thiophosphate, zinc thiocarbamate, or molybdenum thiocarbamate; and (d) 0.05–80 parts by weight, per 100 parts by weight of the composition, of a sulfur-based extreme pressure agent.

9. A machining oil composition according to claim 8, 100 parts by weight of which contains 10 to 70 parts by weight of ingredient (a), 10 to 70 parts by weight of ingredient (b), 10 to 70 parts by weight of ingredient (c), and 10 to 70 parts by weight of ingredient (d).

10. The machining oil composition according to claim 1, comprising 10 to 80 parts by weight, per 100 parts by weight of the composition, of component (b), wherein component (b) comprises 10 to 40 parts by weight, per 100 parts by weight of the composition, of the at least one inorganic carbonate salt.

11. The machining oil composition according to claim 10, comprising 20 to 80 parts by weight, per 100 parts by weight of the composition, of component (b), wherein component (b) comprises 10 to 65 parts by weight, per 100 parts by weight of the composition, of the at least one inorganic sulfonate salt.

12. A machining oil composition consisting essentially of:

(a) a lubricating base oil comprising at least one member selected from mineral oils, fats and oils, and synthetic lubricating oils; and (b) 10 to 80 parts by weight, per 100 parts by weight of the composition, of:

1 to 65 parts by weight, per 100 parts by weight of the composition, of at least one inorganic sulfonate salt selected from an alkali metal sulfonate salt or an alkaline earth metal sulfonate salt; and 1 to 40 parts by weight, per 100 parts by weight of the composition, of at least one inorganic carbonate salt selected from an alkali metal carbonate salt or an alkaline earth metal carbonate salt.

13. The machining oil composition according to claim 12, further consisting essentially of (c) 10–80 parts by weight, per 100 parts by weight of the composition, of at least one zinc thiophosphate, molybdenum thiophosphate, zinc thiocarbamate, or molybdenum thiocarbamate.

14. The machining oil composition according to claim 12, further consisting essentially of (d) 0.05–80 parts by weight, per 100 parts by weight of the composition, of a sulfur-based extreme pressure agent.

15. The machining oil composition according to claim 12, further consisting essentially of:

(c) 10–80 parts by weight, per 100 parts by weight of the composition, of at least one zinc thiophosphate, molybdenum thiophosphate, zinc thiocarbamate, or molybdenum thiocarbamate; and (d) 0.05–80 parts by weight, per 100 parts by weight of the composition, of a sulfur-based extreme pressure agent.

16. The machining oil composition according to claim 12, wherein the oil composition contains substantially no chlorine-based extreme pressure agents.

* * * * *